United States Patent [19]

Fishler

[11] Patent Number: 4,836,508

[45] Date of Patent: Jun. 6, 1989

[54] LADLE SHROUD WITH CO-PRESSED GAS PERMEABLE RING

[75] Inventor: Mark K. Fishler, Brussels, Belgium

[73] Assignee: Vesuvius Crucible Company, Pittsburgh, Pa.

[21] Appl. No.: 189,660

[22] Filed: May 3, 1988

[51] Int. Cl.[4] ..... B22D 11/10

[52] U.S. Cl. ..... 266/220; 164/415; 164/437; 222/603; 266/236

[58] Field of Search ..... 164/259, 415, 337, 437; 222/603, 591; 266/220, 236

[56] References Cited

U.S. PATENT DOCUMENTS 4,519,438 5/1985 Grosso et al. ..... 164/415
4,746,038 5/1988 Ohwada et al. ..... 164/337 X

FOREIGN PATENT DOCUMENTS 59-130662 7/1984 Japan ..... 164/437
60-137557 7/1985 Japan ..... 164/437
62-28051 2/1987 Japan ..... 164/437

*Primary Examiner*—Nicholas P. Godici
*Assistant Examiner*—J. Reed Batten, Jr.
*Attorney, Agent, or Firm*—Webb, Burden, Ziesenheim & Webb

[57] ABSTRACT

A ladle shroud has a co-pressed porous ring for the introduction of an inert gas at the sealing joint between the ladle shroud and a mating ladle collector nozzle. The dense body of the ladle shroud and the co-pressed porous ring are of similar carbon-bonded graphite refractory grain compositions and have similar carbon containing binder systems to improve the bond between the ring and body components. The dense body further includes a continuous integral ledge portion which, abuts a top surface of the porous ring to seal the top of the ring against unwanted inert gas leakage.

14 Claims, 2 Drawing Sheets

LADLE SHROUD WITH CO-PRESSED GAS PERMEABLE RING

BACKGROUND OF THE INVENTION

The present invention relates generally to the continuous casting of steel and to the special ceramic components which are employed therein. More particularly, the invention concerns a ceramic pouring tube, commonly referred to as a ladle shroud, which permits the transfer of molten metal from a ladle to a casting tundish located beneath the ladle. Molten metal is then directed from the tundish into a continuous casting mold or molds positioned beneath the tundish, all in a well-known manner. In a typical continuous steel casting operation, a ceramic collector nozzle is fitted beneath a bottom orifice of the refractory-lined ladle. Control of molten metal flow from the ladle through the collector nozzle is accomplished by either a vertically movable stoppers rod which incrementally opens and closes the opening in the upper end of the collector nozzle, or it is controlled by way of a conventional slide gate plate valve arrangement in which the collector nozzle is mounted on a bottom plate thereof. Relative movement of the slide gate plates opens and closes the metal path to the collector nozzle. The ladle shroud to which the present invention pertains is snugly fitted beneath the collector nozzle to permit the pouring (teeming) of molten metal from the ladle to the tundish located below.

Ladle shrouds are commonly used in the continuous casting of steel to prevent oxidation of the stream of molten steel, as the metal is teemed from the ladle to the tundish, and to protect workers in the casting area from being burned by splashing metal. One of the major problems heretofore encountered in the use of such ladle shrouds is the ability to obtain a tight seal between the collector nozzle and the top of the ladle shroud in the joint area where these components are fitted together. A poor seal at this joint interface results in air infiltration causing objectionable oxidation of the molten steel. It is often very difficult to consistently guarantee the quality of this joint seal due to steel splashing on the collector nozzle or due to handling damage inflicted at the top of the ladle shroud when it is disconnected from a spent ladle and reconnected to a full ladle.

Heretofore, it has been proposed to inject an inert gas around the top of a ladle shroud to provide a gas seal in the event a poor mechanical joint with the collector nozzle is present. The inert gas is nonreactive with the molten steel and when a poor seal is present, the inert gas, such as argon, floods the seal area of the joint preventing the infiltration of air and subsequent oxidation of the molten steel.

Several ladle shroud designs have been heretofore proposed to facilitate the injection of argon around the collector nozzle for sealing purposes. One such design is disclosed in U.S. Pat. No. 4,519,438. In this design, the argon is injected in finger-like grooves which are pressed into the top of the ladle shroud. This design, while partially successful, has some drawbacks. Often the grooves fill up with steel during the casting, making the subsequent injection of inert gas troublesome. It is also often difficult to obtain uniform gas distribution around the seal in that the inert gas has a tendency to assume a higher pressure in the region directly behind the gas inlet connection. As a result, higher flow rates of inert gas injection are necessary to obtain improved gas distribution.

A further attempted solution incorporates a ring of a porous ceramic material in place of the grooves for the injection of argon. Normally the ladle shroud body is composed of an alumina graphite material due to its high thermal shock resistance and ability to withstand attack by molten steel and slag. In this prior art ladle shrod design, the porous ring material does not employ the alumina graphite composition of the body, but rather is a 100% oxide composition, usually consisting of alumina-silicates. This prior porous ring solved one problem present in the groove-type design in that there is no steel infiltration into the porous ring material, and hence a uniform gas.flow rate can be obtained due to the back pressure provided thereby. However, other problems with this prior porous ring design are also encountered. The porous ring is usually inserted into the ladle shroud body after both pieces (ring and shroud body) have been completely finished. This requires a difficult procedure of cementing the porous ring into place, and then encasing the top of the composite ladle shroud in a special steel can. The can serves the purpose of holding the porous ring in place, and insures that a gas-tight seal is obtained around the top of the shroud. If the can is accidentally penetrated or expands, the inert gas will leak either through the hole, or around the top of the shroud. In either case, this greatly reduces the effectiveness of the seal since the gas is not being placed where it is most needed. The probability of having this happen during a casting sequence is quite high.

It has also been proposed to form a preformed ring of porous ceramic material and then co-press the porous ring with the shroud body wherein the porous ring has an inner surface co-extensive with the bore of the shroud and an upper surface co-extensive with the upper surface of the shroud. The co-pressed ring and shroud body with a preformed gas channel are then fired. The resultant fired piece, while offering improved bonding between the porous ring and the body, still requires the use of a steel can with a steel cap portion to prevent inert gas leakage from the exposed top surface area of the porous ring.

The present invention solves these and other shortcomings found in the prior art by providing a ladle shroud having a co-pressed, gas permeable ring which is substantially more effective than commonly used argon shrouds in protecting molten metal from the harmful effects of air infiltration. Unwanted oxidation and nitrogen pickup in the teemed steel is, thus, significantly reduced through the use of the ladle shroud of the present invention. Still further, the co-pressed ladle shroud and gas permeable ring of the present invention is less expensive to manufacture than known gas permeable ladle shrouds due, in part, to the fact that it requires no separate cementing operation and no metal can component for encasing the upper ring surface for sealing against gas leakage.

In addition, the integral porous ring portion and the dense ladle shroud of the invention both are of essentially the same ceramic composition so as to provide uniform thermal expansion and contraction properties therebetween whereby thermal cracking problems are minimized. The invention further provides an integral porous ring having an improved bond with the body which requires no metal cap or cement to hold it in place within the ladle shroud. Still further, improved gas distribution is obtained in the integral porous ring of the present invention through controlled refractory grain sizing in the initial mix which yields a uniform mean pore diameter size after firing.

SUMMARY OF THE INVENTION

These as well as other advantages and benefits are provided by the ladle shroud with co-pressed gas permeable ring of the instant invention. Briefly stated, the present invention comprises a ladle shroud body of an elongated tube shape having a central bore formed therein during a pressing operation. The bore extends from an inlet at an upper end of the shroud body and terminates at an outlet at a lower end thereof. The ladle shroud body is formed of a dense carbon-bonded ceramic material, preferably, an alumina graphite material, having a fired, mean pore diameter size of less than about 10 microns and, more preferably about 0.25 microns. A porous ring preferably of a carbon-bonded alumina graphite material is preformed in a separate pressing operation employing a known gap grain sizing technique in the refractory grain mixture to control the porosity thereof. The refractory grain, such as, for example, alumina, is controlled within a narrow size range of between about 100 to 200 mesh (75 to 150 microns). The graphite, such as a natural vein, flake graphite, for the carbon bond phase has a particle size preferably controlled between about 30 to 100 mesh (about 150 to 600 microns). After co firing with the body, the porous ring has a uniform mean pore diameter size on the order of about 10 microns to 40 microns. Secondary oxide grains of zirconia mullite in amounts of between about 10% to 15% by weight are also preferably included in the porous ring grain mixture. A conventional anitoxidant is also present in the mixture, such as, for example, boron or silicon containing materials. A binder, preferably a carbonaceous resin, pitch or the like carbonaceous material, is also employed. Use of an identical or similar carbonaceous binder system in the porous ring and ladle shroud body is preferred so as to improve the bonding at the interface between the porous ring and body components during pressing and firing.

As stated above, the porous ring is preformed and the so-called "green", unfired preform is then coated on an outside diameter with a material, such as a wax or like substance that will burn out in the final firing of the body. This coating forms a channel or manifold in the fired body so that the later injected inert gas may be evenly distributed around the porous ring. The coating material generally covers about 50% or less of the thickness of the porous ring which is sufficient to yield proper inert gas distribution while also providing enough wall area to obtain improved bonding between the porous ring and the body during the co-pressing. The co-pressing and co-firing operations also serve to seal off the porous ring at the top so that inert gas is forced through the gas channel and into the porous ring rather than leaking through the top.

During manufacture, the coated, preformed green porous ring is placed over a pressing mandrel used to form the ladle shroud body. The alumina graphite shroud body grain mixture is then poured into the tooling surrounding the porous ring. The refractory grain mixture forming the body fills the mold cavity to a level above the top surface of the green porous ring. The tooling is next sealed and placed into an isostatic press where the porous ring is then integrally bonded to the alumina graphite body. In the fired state, the dense grained shroud body forms an integral ledge portion extending around the top of the porous ring forming a seal above the porous ring to prevent inert gas leakage therefrom. After conventional firing, the previously mentioned material used to make the gas channel has disappeared leaving an open annular manifold through which the inert gas is distributed. A gas connection may be formed through the body such as by drilling from the outer wall of the ladle shroud into the manifold.

DETAILED DESCRIPTION OF THE INVENTION

Figure 1:
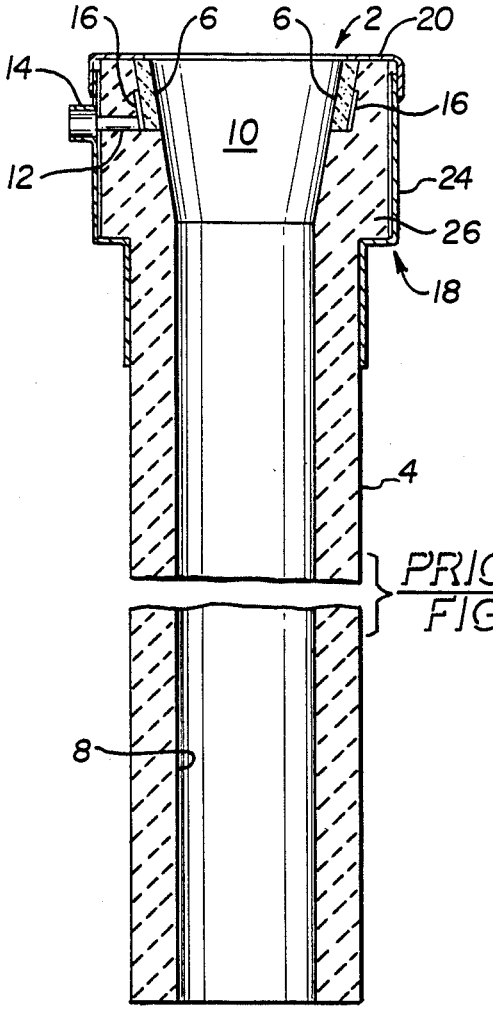
PRIOR ART FIG. 1
FIG. 1 is a cross-sectional side elevation view of a prior art ladle shroud having a gas permeable ring encased in a steel can including a cap portion.
Figure 2:
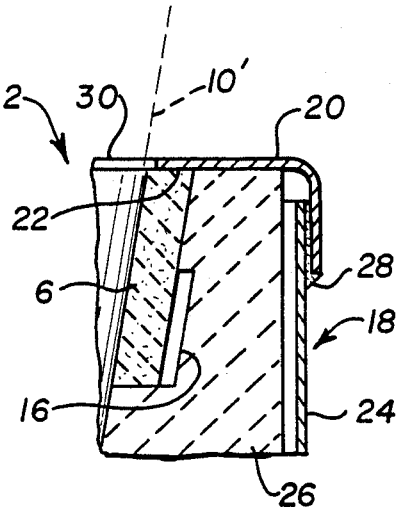
PRIOR ART FIG. 2
FIG. 2 is an enlarged, partially fragmented sectional view of a portion of the gas permeable ring and steel can of the prior art ladle shroud of FIG. 1.

Referring now to the drawings, FIGS. 1 and 2 show one type of prior art ladle shroud designated generally by reference numeral 2. Ladle shroud 2 includes a dense ceramic body 4 and a gas permeable, porous ring-shaped portion 6 affixed at the top thereof. The prior art shroud has a central bore 8 formed therethrough which permits the passage of molten steel from a ladle to a tundish (not shown) in a well-known manner. An upper portion 10 of the bore 8 is formed in a frusto-conical shape to fit onto a conventional collector nozzle (not shown) carried above by the ladle. A surface of the collector nozzle is indicated by phantom line 10' in FIG. 2 as it would lie in relation to the surface 10 of the ladle shroud. A gas passageway 12 is formed such as by drilling through the ladle body 4 near the top thereof. Passageway 12 communicates at an outer end with a threaded fitting 14 at the outer surface of the shroud for communication with a source of pressurized inert gas, such as argon gas. The other end of the passageway 12 communicates with a channel or manifold 16 for distribution of the argon gas around the porous ring 6. The pressurized gas transverses the cross section of the ring 6 through the pores thereof to be expelled along the bore surface 10 in an attempt to minimize air infiltration into the flowing stream of metal by way of openings between the surface 10 and the adjacent surface 10' of the collector nozzle shown in FIG. 2.

As is observed in FIGS. 1 and 2, the porous ring 6 of this prior art shroud 2 requires the use of a steel can 18 having a cap 20 to sealably engage the upper surface 22 of the porous ring 6 in order to prevent the escape of inert gas therefrom. A typical prior art steel can 18 includes a cylindrical skirt portion 24 which encircles the upper region 26 of the ladle shroud. The separate steel cap 20 is secured to the skirt 24 at weld bead 28. The cap 20 also has an open area 30 formed in the center to permit the insertion of the collector nozzle therethrough. In addition to preventing gas leakage from porous surface 22, the prior art metal cap 20 also functions to aid in holding the porous ring 6 in place in certain of the prior art porous ring designs. Commonly, in the prior art the porous ring may either be a separately pressed and fired piece or it may be a preformed and co-pressed insert such as ring 6. In either case, these typical types of prior art porous rings have exposed top surfaces, such as surface 22, which require sealing by a separate steel enclosure such as the cap 20. In addition, the prior art porous ring inserts and shroud bodies are usually made from different refractory grain mixtures, such as, for example, a 100% oxide composition of alumina-silicates forming the porous ring and alumina graphite material forming the dense body. Hence, both thermal expansion and bonding problems, in addition to inert gas leakage, commonly exist in such prior art ladle shrouds.

Figure 3:
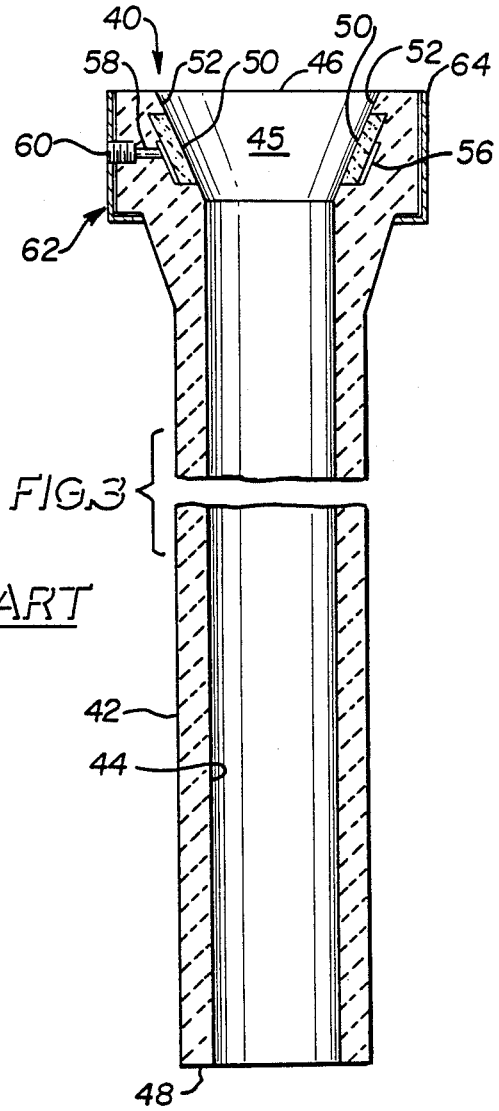
FIG. 3 is a cross-sectional side elevation view of a co-pressed ladle shroud and gas permeable ring of the present invention.
Figure 4:
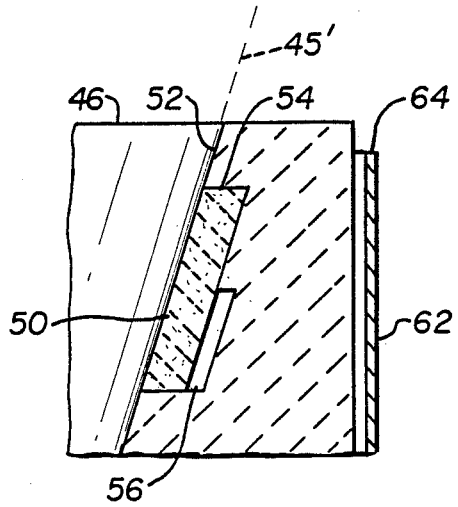
FIG. 4 is an enlarged, partially fragmented sectional view of a portion of the gas permeable ring and ladle shroud of FIG. 3.

A ladle shroud 40 according to the present invention, is shown in FIGS. 3 and 4 which solves many of the problems found in the prior art. The shroud 40 includes a tubular body portion dense refractory material, having spaced upper and lower ends 46 and 48, respectively, and a bore 44 for molten metal therethrough. Shroud 40 comprises the body portion 42, preferably of a carbon-bonded alumina graphite refractory composition and possesses a relatively dense, non-porous structure. The porosity of the shroud body 42 is controlled to achieve a mean pore diameter of no greater than about 10 microns and, more preferably, controlled to a mean pore diameter of about 0.25 microns. The binding system employed in the refractory grain mix for the body 42 preferably comprises a carbonaceous material, such as resin or pitch. A typical refractory grain composition for the shroud body 42 consists essentially of a mixture of alumina grains and graphite, preferably in the form of natural vein, flake graphite. Some silica and zirconia diluting refractory oxide grain may also be present along with a conventional antioxidant such as a boron or silicon containing material. The graphite has a typical particle size ranging between about 30 to about 100 mesh or about 150 to about 500 microns. Dense grain packing and consequent small mean pore diameter sizes are obtained in a known manner using a mixture of coarse and fine sized alumina grains, for example, −30 mesh coarse alumina grains, are mixed with fine alumina grains, −325 mesh, in a ratio of about 2:1 (coarse:fine) to form body portion 42. In this manner, a high packing density is achieved to yield a desired low porosity and low gas permeability in the shroud body. An exemplary composition of the fired ladle shroud body 42 may consist of the following, in weight percent: 53% alumina; 31% carbon; 13% silica; 1% zirconia and 2% other constituents.

A porous ring 50 is preformed from a similar alumina graphite composition, then co-pressed as a green preform with the shroud body 42 and fired as a unitary piece to form the finished ladle shroud 40. The porous ring 50, as will be explained in greater detail below, is co-pressed with the body 42 in such a manner that an integral, dense ledge portion 52 is formed at the upper end 46 of the shroud body to enclose an upper edge surface 54 of the porous ring completely around the perimeter of the body. In this manner, the porous ring 50 is sealed at its upper edge 54, thus, eliminating the need for the expensive prior welded steel can cap 20 of FIGS. 1 and 2 to prevent gas leakage therefrom.

The porous ring 50 preferably consists essentially of a carbon-bonded alumina graphite refractory material preferably with an identical or similar carbon containing binder system to that employed in the shroud body 42. A carbonaceous binder such as resin or pitch is preferred. Uniform mean pore diameters on the order of about 10 microns are obtained for the porous ring 50. Mean pore diameters may, however, range upwardly to about 40 microns to permit uniform inert gas permeation therethrough while not being so large as to allow permeation of molten metal through the ring 50 in a reverse direction.

In a presently preferred embodiment, the mean pore diameter size in the porous ring 50 is about 10 microns and the mean pore diameter size in the dense alumina graphite shroud body is about 0.25 microns. In order to obtain such, the particle size distribution of the refractory oxide grain mix for the porous ring 50, such as alumina grain, is controlled within a relatively narrow range. Preferably the refractory oxide grain size is controlled between about 100 to about 200 mesh, or about 75 to about 150 microns. This grain gap sizing technique provides the desired substantially uniform mean pore diameter size of about 10 microns in the porous ring after firing. The graphite utilized in the porous ring 50 mix composition is also natural vein or flake graphite having a particle size of about 30 to about 100 mesh (about 150 to about 600 microns). The porous ring composition also preferably contains a secondary oxide diluting grain of zirconia mullite, comprising constituents of $ZrO_2$, $Al_2O_3$, $SiO_2$ in amounts from about 10% to about 15% by weight. A conventional antioxidant is also preferably added to the mixture in the form of boron containing or silicon containing compounds.

The binders employed in the porous ring 50 and the dense alumina graphite body 42 are similar carbonaceous binder systems and preferably are identical. A carbonaceous binder such as resin or pitch may be used. The shroud body mix could employ a resin binder system while the porous ring mix could use a pitch binder system. Ideally, however, an identical binder system is employed. Use of similar or identical binder systems along with similar carbon-bonded refractory mixes improves the bonding between the porous and non-porous sections of the ladle shroud 40. An exemplary composition for the fired porous ring 50 may consist of the following in weight percent: 61% alumina; 22% carbon; 6% silica; 6% zirconia and 5% other constituents. It is important to note that the fired bond between the refractory grains of the body and the grains of the porous ring and between the grains at the body-ring interface wall be the same, that is, an identical carbon bond. This carbon bond is supplied in the main, from the graphite constituent, however, some of the carbon bond is also supplied from the binder system.

An open gas channel or manifold 56 is also formed during firing around a portion of the interface between the porous ring 50 and body 42 to permit entry of the inert gas to the porous ring. After preforming the porous ring 50, the green piece is coated on its outside diameter with a burnable or meltable material, such as a wax, which will disappear during the later firing operation. The coating generally covers about 50% or less of the ring thickness so as to provide proper gas distribution while also leaving sufficient wall contact so as to obtain strong bonding attachment between the porous ring 50 and the shroud body during co-pressing and subsequent firing operations. During manufacture, the coated preformed porous ring 50 is placed over a pressing mandrel of the ladle shroud. The alumina-graphite body grain composition is then poured into the tooling surrounding the porous ring. This refractory grain mixture forming the body 42 fills the mold tooling to a level beyond the top surface 54 of the ring so as to encase the porous ring with an annular ledge portion 52 of the low porosity refractory grain mixture of the shroud body. The tooling is sealed and the ring 50 and body 42 are then co-pressed isostatically in a conventional manner. The co-pressed piece 40 is then removed from the tooling and fired, also in a known manner. During firing, the material coating the outside of the ring 50 disappears leaving an annular gas manifold 56 extending 360° around the porous ring 50 A gas conduit 58 is then formed such as by drilling through the body to contact the manifold 56 at one end. An outer end of the gas conduit 58 is fitted with a conventional threaded member 60 for later attachment to a source of pressurized inert gas such as argon.

A supporting steel can 62 may also be fitted around an upper area of the ladle shroud 40 to serve as an aid in mounting the ladle shroud within a conventional piece of casting equipment (not shown). The can 62 terminates at an upper edge 64 spaced below the upper surface 46 of the ladle shroud. The can 62 is, thus, much simpler than the welded can 24 and cap 20 of the prior art. Since the integral ledge 52 of the shroud body 42 seals gas leakage from the upper edge 54 of the porous ring, there is no requirement for a metal sealing cap, such as the previously described prior art cap 20 of FIGS. 1 and 2. The cap welding or brazing step required in the prior art is therefore also eliminated.

In operation, a frusto-conically shaped upper bore 45 of the ladle shroud 40 is adapted to closely engage and form a joint with an outer surface 45' of the collector nozzle, shown in phantom lines in FIG. 4. During casting, inert gas, such as argon, is introduced to the ladle shroud 40 from a pressurized source at fitting 60. The pressurized inert gas flows around the manifold 56 and then permeates the porous ring 50 to enter the space at the joint interface between the collector nozzle surface 45' and the surface of the conical bore 45 of the ladle shroud. The inert gas flows upwardly along any of the small gaps which may be present at the joint interface and prohibits the harmful influx of air in a reverse direction. In this manner, air is prevented from being drawn into the stream of molten steel as it passes through the collector nozzle to the ladle shroud due to the uniform flow of the inert gas from the porous ring 50. The integral, dense refractory ledge 52 of the body seals upward gas leakage through surface 54 of the porous ring to prevent any short-circuit gas flow patterns and, thus, provides the required uniform inert gas flow around the entire circumference of the collector nozzle. Such uniform inert gas flow also prevents the formation of a vacuum in cases where the collector nozzle and ladle shroud are tightly sealed at the joint interface. When such a vacuum is created, air may be sucked through the ladle shroud body or through any cracks which may be present in the connecting joints. The uniform injection of inert gas provided by the invention, when such a tightly sealed ladle shroud is experienced, also further prevents the unwanted formation of a vacuum in the lower casting tube.

Figure 5:
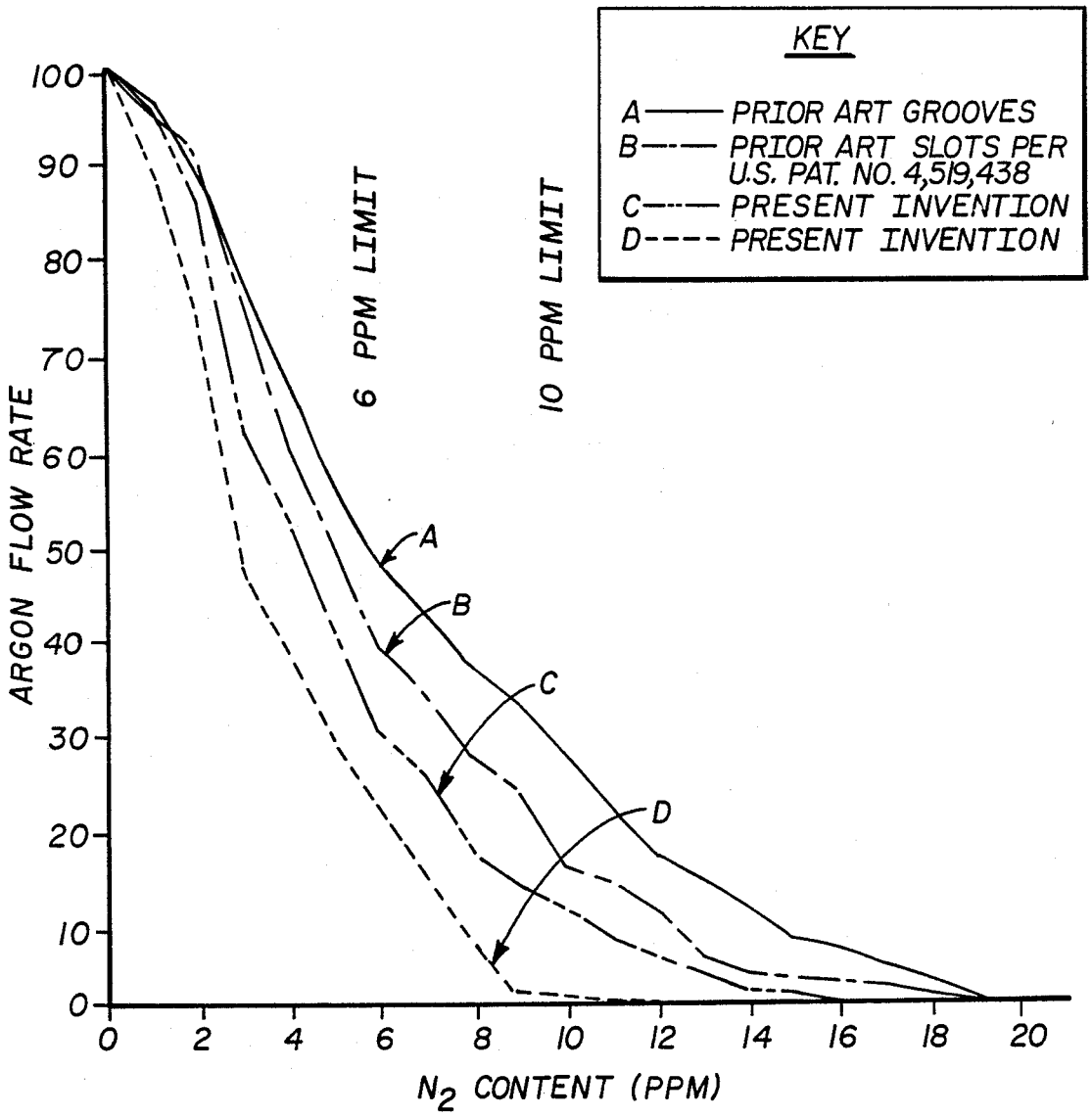
FIG. 5 is a graphical representation of comparative test results of ladle shrouds of the present invention versus prior art shrouds in actual steel casting runs.

Ladle shrouds of the invention having porous ring sections as shown in FIGS. 3 and 4 were fabricated and tested at a commercial continuous steel caster. At this manufacturing plant, the effectiveness of a ladle shroud in protecting a stream of molten metal from the air is measured by the amount of nitrogen pickup in the steel as it is transferred from a ladle to a tundish. FIG. 5 graphically shows the results of the co-pressed porous ring ladle shroud of the present invention compared to traditional groove and slot type ladle shrouds of the prior art. It can be observed that the shroud of the present invention is substantially more effective than the groove or slotted types in reducing nitrogen pickup at a constant flow rate of argon. The prior art ladle shrouds are represented by curves A and B which are designs similar to or the same as that disclosed in U.S. Pat. No. 4,519,438. The curves identified by the letters C and D represent ladle shrouds having co-pressed gas permeable rings of the present invention. Both of the ladle shrouds C and D performed in a superior manner by obtaining low leakage of air/nitrogen at the same level of argon than the prior art ladle shrouds represented by curves A and B. For example, at the 6 parts per million (ppm) level of nitrogen pickup, the grooved test shroud A required a relative argon flow rate of about 48%; slotted test shroud B according to U.S. Pat. No. 4,519,438 required an argon flow of about 40%; shrouds C and D of the present invention required argon flow rates of about 30% and 22%, respectively. The economy of the present invention in inert gas usage is quite apparent.

Having thus described my invention with the detail and particularity required by the patent laws, what is claimed and desired to be protected by Letters Patent is set forth in the following claims.

I claim:

1. A casting shroud adapted to be detachably fitted to a collector nozzle of a ladle or like vessel for use in casting molten metal comprising:

a tubular body of a dense refractory material having spaced upper and lower ends and a bore formed therethrough said bore having a frusto-conically shaped portion adjacent the upper end of the body to conform with a profile of said collector nozzle;

a porous refractory ring co-pressed and fixed with said body and forming a portion of said bore at said frusto-conically shaped portion, said body including an integral ledge interposed between said porous ring and the upper end of said body adapted to prevent gas leakage from an upper surface of said porous ring, said porous ring adapted to face a lower outer surface portion of the collector nozzle; and means associated with said body communicating with said porous ring for the supply of an inert gas to the porous ring, whereby, in use, inert gas is delivered to an interface area between the porous ring and said collector nozzle to prevent infiltration of air therebetween.

2. A casting shroud according to claim 2 wherein the body and the porous ring both comprise predominantly carbon-bonded alumina refractory material.

3. A casting shroud according to claim 2 wherein the dense body has a mean pore diameter size of between about 0.25 to less than about 10 microns and the porous ring has a mean pore diameter size of between about 10 to about 40 microns.

4. A casting shroud according to claim 2 wherein the porous ring includes a secondary oxide refractory grain constituent.

5. The casting shroud of claim 4 wherein the secondary oxide refractory grain constituent is a zirconia mullite material.

6. A casting shroud according to claim 1 including metal can means encasing a portion said body and terminating at a position no higher than upper end of said shroud body.

7. A casting shroud for use in casting molten metal comprising:

a generally tube-shaped body of a dense carbon-bonded metal oxide-graphite composition and having an upper end and a lower end and a bore formed therethrough wherein the carbon bond is supplied predominantly from the graphite;

a porous ring co-pressed with said body and of the same general carbon-bonded metal oxide graphite composition of said body wherein the carbon bond is supplied predominantly from the graphite, said porous having an inner surface forming a portion of said bore to the upper end of said body, said porous ring also having an outer surface spaced from said inner surface and an upper surface spaced from the upper end of the body, said ring having a controlled pore size formed by a grain gap sizing technique to permit permeation of an inert gas therethrough and to prevent reverse permeation of molten metal;

an integral ledge portion carried by the ladle shroud body in contact with the upper surface of the porous ring adapted to prevent gas leakage from said upper surface; and means formed in said body adapted to communicate at one end with a pressurized source of inert gas and to communicate at another end to the inner surface of the porous ring, whereby in use, said inert gas permeates said porous ring to be dispersed at said inner surface.

8. The casting shroud of claim 7 wherein the body and porous ring are co-pressed from refractory mixes having similar binder systems selected from one comprising pitch, resin or a like carbonaceous binder.

9. The casting shroud of claim 7 wherein the body and porous ring are co-pressed from refractory mixes having similar carbonaceous binder systems and wherein a major portion of said refractory mixes comprises alumina and graphite.

10. The casting shroud of claim 9 wherein the porous ring includes a secondary oxide refractory grain of a zirconia mullite material.

11. The casting shroud of claim 7 wherein the porous ring has a mean pore size of between about 10 to about 40 microns when in a fired state.

12. The casting shroud of claim 11 wherein the porous ring is co-pressed from a gap-grain sized refractory mix having a refractory grain size of between about 100 to 200 mesh (about 75 to 150 microns) and including a graphite constituent having a particle size of between about 30 to 100 mesh (about 150 to 600 microns).

13. The casting shroud of claim 11 wherein the body when in a fired state has a mean pore size of less than 10 microns to about 0.25 micons.

14. The casting shroud of claim 7 including steel can means encircling the ladle shroud body adjacent the upper end thereof for supporting said shroud in a metal casting apparatus and wherein said steel can means includes an upper edge portion which terminates at a position no higher than a top surface of the upper end of the ladle shroud.

* * * * *

UNITED STATES PATENT AND TRADEMARK OFFICE

CERTIFICATE OF CORRECTION

PATENT NO. : 4,836,508

DATED : June 6, 1989

INVENTOR(S) : Mark K. Fishler

It is certified that error appears in the above-identified patent and that said Letters Patent is hereby corrected as shown below:

In the Abstract Line 10 after "continuous" insert --,--.

In the Abstract Line 10 after "which" delete --,--.

Column 1 Line 20 "stoppers" should read --stopper--.

Column 2 Line 9 "shrod" should read --shroud--.

Column 3 Line 28 "co firing" should read --co-firing--.

Column 3 Lines 33-34 "anitoxidant" should read --antioxidant--.

Column 5 Line 19 after "portion" insert --42 of a--.

Column 5 Line 21 after "for" insert --passage of--.

UNITED STATES PATENT AND TRADEMARK OFFICE

CERTIFICATE OF CORRECTION

PATENT NO. : 4,836,508 Page 2 of 2

DATED : June 6, 1989

INVENTOR(S) : Mark K. Fishler

It is certified that error appears in the above-identified patent and that said Letters Patent is hereby corrected as shown below:

Column 7 Line 11 after "50" insert --.--.

Claim 1 Column 8 Line 38 "fixed" should read --fired--.

Claim 2 Column 8 Line 53 "2" should read --1--.

Claim 2 Column 8 Line 55 before "carbon-bonded" insert --a--.

Claim 7 Column 9 Line 14 after "porous" insert --ring--.

Claim 7 Column 9 Line 15 after "bore" insert --adjacent--.

Signed and Sealed this

Twenty-fourth Day of April, 1990

*Attest:*

HARRY F. MANBECK, JR.

*Attesting Officer*

*Commissioner of Patents and Trademarks*